US005748170A

United States Patent [19]

Goto

[11] Patent Number: 5,748,170

[45] Date of Patent: May 5, 1998

[54] DISPLAY DRIVING APPARATUS WITH AUTOMATIC DRIVE VOLTAGE OPTIMIZATION

[75] Inventor: Tetsuro Goto, Funabashi, Japan

[73] Assignee: Nikon Corporation, Tokyo, Japan

[21] Appl. No.: 482,850

[22] Filed: Jun. 7, 1995

Related U.S. Application Data

[63] Continuation of Ser. No. 339,290, Nov. 10, 1994, abandoned, which is a continuation of Ser. No. 10,988, Jan. 29, 1993, abandoned.

[30] Foreign Application Priority Data

| | | | |
|---|---|---|---|
| Feb. 3, 1992 | [JP] | Japan | 4-047469 |
| Feb. 3, 1992 | [JP] | Japan | 4-047470 |
| Feb. 3, 1992 | [JP] | Japan | 4-047471 |

[51] Int. Cl.[6] ..... G09G 3/34

[52] U.S. Cl. ..... 345/101; 345/87

[58] Field of Search ..... 340/784, 805, 340/765, 811; 354/410, 432, 219; 345/87, 89, 92, 101, 50, 52; 359/86, 56, 57, 59

[56] References Cited

U.S. PATENT DOCUMENTS

| | | | |
|---|---|---|---|
| 3,921,162 | 11/1975 | Fukai et al. | 340/784 |
| 4,386,345 | 5/1983 | Narveson et al. | 345/20 |
| 5,027,111 | 6/1991 | Davis et al. | 340/784 |
| 5,041,821 | 8/1991 | Onitsuka et al. | 359/86 |
| 5,066,945 | 11/1991 | Kanno et al. | 340/784 |
| 5,122,827 | 6/1992 | Saegusa et al. | 354/410 |
| 5,202,668 | 4/1993 | Nagami | 345/211 |

FOREIGN PATENT DOCUMENTS

| | | | |
|---|---|---|---|
| 0329399 | 8/1989 | European Pat. Off. | 345/89 |
| 1172820 | 7/1989 | Japan | 345/101 |
| 4-24611 | 1/1992 | Japan . | |

*Primary Examiner*—Chanh Nguyen
*Attorney, Agent, or Firm*—Shapiro and Shapiro

[57] ABSTRACT

A display driving apparatus, which can automatically optimize a visual state in accordance with a temperature in a photographing operation, a photographing attitude of a user, and a user's preference, is disclosed. The apparatus may include an electro-optical display unit, a temperature detection unit for detecting an ambient temperature of the electro-optical display unit, and generating a temperature detection signal, a bias value generation unit for generating a bias value to the electro-optical display unit, a changing unit for changing the bias value, a storage unit for storing a plurality of bias values changed by the changing unit in correspondence with the temperature detection signals, and a bias value control unit for executing statistical processing of the plurality of bias values stored in the storage unit, and controlling the bias value generation unit on the basis of the processing result.

13 Claims, 4 Drawing Sheets

DISPLAY DRIVING APPARATUS WITH AUTOMATIC DRIVE VOLTAGE OPTIMIZATION

This is a continuation of application Ser. No. 08/339,290 filed Nov. 10, 1994, now abandoned, which is a continuation of application Ser. No. 08/010,988 filed Jan. 29, 1993, now abandoned.

BACKGROUND OF THE INVENTION

1. Field of the Invention

The present invention relates to a display driving apparatus for driving a display device such as a liquid crystal panel (to be abbreviated to as an LCD hereinafter) which displays an operation state of electronic equipment.

2. Related Background Art

In recent electronic equipment such as cameras, personal computers, and the like, since the amount of information to be displayed tends to increase, it is of urgent necessity to increase the displayable information amount without increasing the size of electronic equipment itself.

In order to satisfy such necessity, most of static LCD driving methods in conventional devices are replaced with dynamic methods. In the dynamic method, the ON/OFF states of a plurality of segments are controlled by a single line by utilizing multiplexing of driving signals, i.e., high- and low-level driving voltage values, which appear periodically.

According to this method, the number of displayable segments can be increased without increasing the number of electrodes of an LCD. In this case, the duty ratio is called, e.g., "¼" according to the number of segments corresponding to a single electrode.

In an extreme application, as a further developed method of the dynamic method, a so-called dot-matrix display method capable of arbitrarily changing a display pattern by a driving circuit independently of the shape of a segment is popularly used.

In this method, an LCD is constituted by segments defined by square dots, which are regularly aligned on the entire panel surface, and is driven by electrodes connected in a matrix in the vertical and horizontal directions. In this method, a high duty ratio of 1/64 or higher is adopted.

In both the dynamic and dot-matrix methods, the duty ratio is expected to increase in the future.

An LCD has temperature dependency and visual angle dependency. In principle, the ON/OFF state of the LCD is controlled by a voltage value to be applied. In this case, the threshold level changes depending on the temperature. Therefore, when the multiplexed driving voltage is constant, the ON/OFF boundary changes according to a change in environmental temperature.

More specifically, a segment to be turned off may be kept ON at a high temperature; a segment to be turned on may be kept OFF at a low temperature.

Since the LCD utilizes polarized light, the ON/OFF boundary of the segments changes depending on the visual angle.

In order to solve such problems of the temperature dependency and visual angle dependency, since the driving voltage value, i.e., a bias value, need only be changed, a conventional display driving apparatus is provided with a dial on its external portion, and the rotation of the dial is interlocked with the value of a semi-fixed resistor. Thus, a user himself or herself adjusts the bias value.

As a display driving apparatus for solving the problem of temperature dependency alone, a driving circuit is provided with a thermistor or the like, and temperature correction is automatically performed to some extent.

In the former conventional display driving apparatus, every time the environmental temperature or visual angle is changed, a user must adjust the dial to change the bias value so as to obtain an optimal visual state.

In the latter display driving apparatus for automatically performing temperature correction, a temperature range effective for the automatic temperature correction is narrow, and in addition, fine adjustment must be performed every time the visual angle is changed.

In the particular case of a camera, there is a very wide use temperature range, unlike general office automation equipment, it is expected for a user to frequently perform adjustment. The user may lose an important shutter chance due to the adjustment.

SUMMARY OF THE INVENTION

It is an object of the present invention to provide a display driving apparatus, which can automatically optimize the visual state of a display device in correspondence with a temperature in a photographing operation.

It is another object of the present invention to provide a display driving apparatus, which can automatically optimize the visual state of a display device in correspondence with a photographing attitude of a user.

It is still another object of the present invention to provide a display driving apparatus, which can automatically optimize the visual state of a display device in accordance with a user's preference.

In order to achieve the above objects, a display driving apparatus according to the present invention comprises an electro-optical display unit (6), a temperature detection unit (21) for detecting an ambient temperature of the electro-optical display unit (6), and generating a temperature detection signal, a bias value generation unit (23) for generating a bias value to the electro-optical display unit, a changing unit for changing the bias value, a storage unit (22) for storing a plurality of bias values changed by the changing unit in correspondence with the temperature detection signals, and a bias value control unit (26, S42, S43) for executing statistical processing of the plurality of bias values stored in the storage unit, and controlling the bias value generation unit on the basis of the processing result.

In this case, the changing unit comprises a manual adjustment unit (7, 8) capable of changing the bias value to an arbitrary value, and the storage unit stores a plurality of bias values adjusted by the manual adjustment unit in correspondence with the temperature detection signals. The bias value control unit executes statistical processing of the bias values stored in the storage unit, and controls the bias value generation unit to generate a bias value according to the temperature detection signal.

According to the present invention, a plurality of adjusted bias values, are stored in the storage unit in correspondence with temperature, and the bias value control unit executes statistical processing of the plurality of stored bias values so as to automatically optimize the display state of the electro-optical display unit via the bias value generation unit.

According to another aspect of the present invention, a display driving apparatus comprises an electro-optical display unit (6), an attitude detection unit (9) for detecting the attitude of the electro-optical display unit, and generating an attitude detection signal, a bias value generation unit (23) for generating a bias value to the electro-optical display unit, a changing unit for changing the bias value, a storage unit (22) for storing a plurality of bias values changed by the changing unit in correspondence with the attitude detection signals, and a bias value control unit (26, S42, S44) for executing statistical processing of the plurality of bias values stored in the storage unit, and controlling the bias value generation unit on the basis of the processing result.

In this case, the changing unit comprises a manual adjustment unit (7, 8) capable of changing the bias value to an arbitrary value, and the storage unit stores a plurality of bias values adjusted by the manual adjustment unit in correspondence with the attitude detection signals. The bias value control unit executes statistical processing of the bias values stored in the storage unit, and controls the bias value generation unit to generate a bias value according to the attitude detection signal.

According to the present invention, a plurality of adjusted bias values are stored in the storage unit in correspondence with attitude, and the bias value control unit executes statistical processing of the plurality of stored bias values so as to automatically optimize the display state of the electro-optical display unit via the bias value generation unit.

According to still another aspect of the present invention, a display driving apparatus comprises an electro-optical display unit (6), a bias value generation unit (23) for generating a bias value to the electro-optical display unit, a manual adjustment unit (7, 8) capable of adjusting the bias value generated by the bias value generation unit to an arbitrary value, a storage unit (22) for storing a plurality of bias values adjusted by the manual adjustment unit, and a bias value control unit (26, S42) for executing statistical processing of the plurality of bias values stored in the storage unit, and controlling the bias value generation unit on the basis of the processing result.

In this case, the bias value control unit may weigh a later one of the plurality of stored bias values with a larger value in statistical processing.

The bias value control unit may calculate a square mean or arithmetic mean of the plurality of stored bias values in statistical processing.

Furthermore, the bias value control unit may execute the statistical processing by excluding the maximum value and/or the minimum value from the plurality of stored bias values.

According to the present invention, a plurality of bias values, which are adjusted in accordance with a user's preference, are stored in the storage unit, and the bias value control unit executes statistical processing of the plurality of stored bias values so as to automatically optimize the display state of the electro-optical display unit via the bias value generation unit.

DESCRIPTION OF THE PREFERRED EMBODIMENT

The preferred embodiment of the present invention will be described in detail hereinafter with reference to the accompanying drawings.

Figure 1:
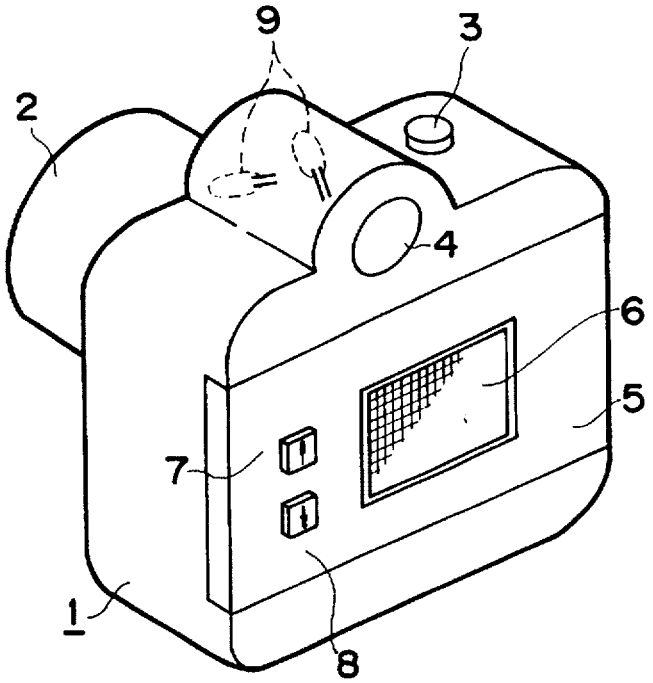
FIG. 1 is a perspective view showing the outer appearance of a display driving apparatus according to an embodiment of the present invention.

FIG. 1 is a perspective view showing the outer appearance of a display driving apparatus according to an embodiment of the present invention.

The display driving apparatus of this embodiment is applied to a single-lens reflex camera 1. A lens 2 is mounted on the camera 1, and a shutter button 3 is depressed to perform an exposure operation after an object is confirmed through a finder 4.

A back lid 5 is attached to the back surface of the camera 1, and is provided with an LCD 6. The LCD 6 displays, e.g., a proper exposure condition for an object, which is photometrically calculated by the camera 1, and is driven by the dot-matrix method.

Density adjustment buttons 7 and 8 are arranged beside the LCD 6 on the back lid 5. The density adjustment buttons 7 and 8 are buttons for adjusting the display density of the LCD 6. The density adjustment button 7 is used when the display density of the LCD 6 is to be increased; the density adjustment button 8 is used when the display density is to be decreased.

In this embodiment, the density adjustment of the LCD 6 is finally automatically performed. In this case, the density adjustment buttons 7 and 8 are used for inputting a condition including a preference of a photographer.

In the camera 1, a plurality of mercury switches 9 are arranged in the finder 4 to have a predetermined angular relationship therebetween. The mercury switch 9 detects its attitude when mercury sealed in a glass tube contacts an internal electrode.

Since the plurality of mercury switches 9 are arranged in the camera 1 to have the predetermined angular relationship therebetween, as shown in FIG. 1, they can detect the attitude of the camera 1 to which these mercury switches 9 are attached. The attitude to be detected includes, e.g., an ordinary position, a vertical position, an upside-down position, and the like.

The mercury switches 9 are known to those who are skilled in the art and detect the attitude of the camera 1, which attitude is used in judgment processing of multi-split photometric operations, so that the precision of proper exposure is improved by discriminating the attitude of the camera 1. In this embodiment, as will be described later, an attitude detection unit constituted by the mercury switches 9 is used in correction of visual angle dependency of the LCD.

Figure 2:
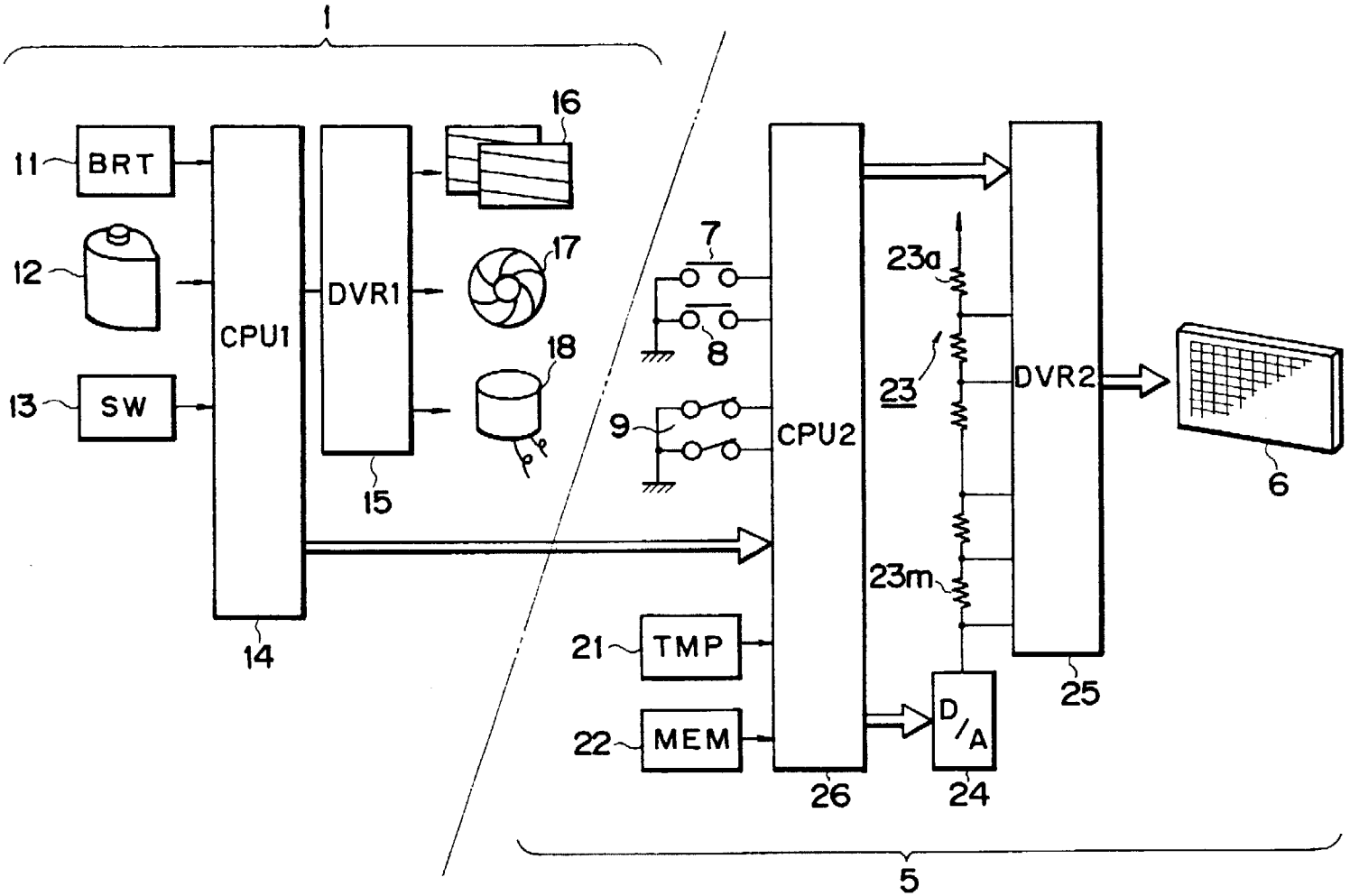
FIG. 2 is a block diagram showing the display driving apparatus according to the embodiment of the present invention.

FIG. 2 is a block diagram showing the display driving apparatus according to the embodiment of the present invention.

FIG. 2 illustrates electrical circuits in the camera 1 and the back lid 5. In FIG. 2, a circuit illustrated on the left side of the broken line corresponds to the camera 1, and a circuit on the right side thereof corresponds to the back lid 5.

The arrangement of the camera 1 side will be described below.

A CPU 14 receives a brightness signal associated with an object from a photometry circuit 11, a speed signal of a film in use from a film speed detection circuit 12, an operation signal of the shutter button 3 and various switch signals expressing an internal sequence execution condition of the camera 1 from a switch detection circuit 13, and the like.

The output from the CPU 14 operates, via a driving circuit 15, a shutter 16 for exposing a film for a predetermined period of time, an aperture 17 for controlling the light amount to be transmitted from the lens 2 to the film, and a wind-up motor 18 for winding up the film by one frame after exposure.

The CPU 14 transmits a display signal, and the like to a CPU 26 in the back lid 5 via a plurality of contacts (not shown).

The arrangement of the back lid 5 will be described below.

The CPU 26 receives a density adjustment signal for the LCD 6 from one of the density adjustment buttons 7 and 8, the attitude signals of the camera 1 from the plurality of mercury switches 9, the display signal from the above-mentioned CPU 14, a temperature signal from a temperature detection circuit 21, and an LCD density signal from a memory circuit 22.

The memory circuit 22 has a bidirectional signal exchange mode. The circuit 22 outputs an LCD density signal to the CPU 26, or receives an LCD density signal therefrom.

The output signal from the CPU 26 drives the LCD 6 via a driving circuit 25, and controls the output voltage from a D/A converter 24. In a conventional apparatus, temperature adjustment is performed by a semi-fixed resistor whose resistance is varied manually, a thermistor whose resistance changes depending on the temperature, or the like. However, in this embodiment, the D/A converter 24 is used.

The D/A converter 24 is connected to a ladder resistor 23 consisting of a plurality of resistors 23*a* to 23*m*. Since the upper end of the ladder resistor 23 is fixed at a power supply voltage (not shown), and its lower end is fixed at the output from the D/A converter 24, as described above, the voltage-divided values among the resistors 23*a* to 23*m* are controlled by the output from the D/A converter 24.

The voltage-divided outputs among the resistors 23*a* to 23*m* are input to the driving circuit 25, and are multiplexed on a driving waveform for the LCD 6.

The operation of the display driving apparatus of this embodiment will be described below.

Figure 3:
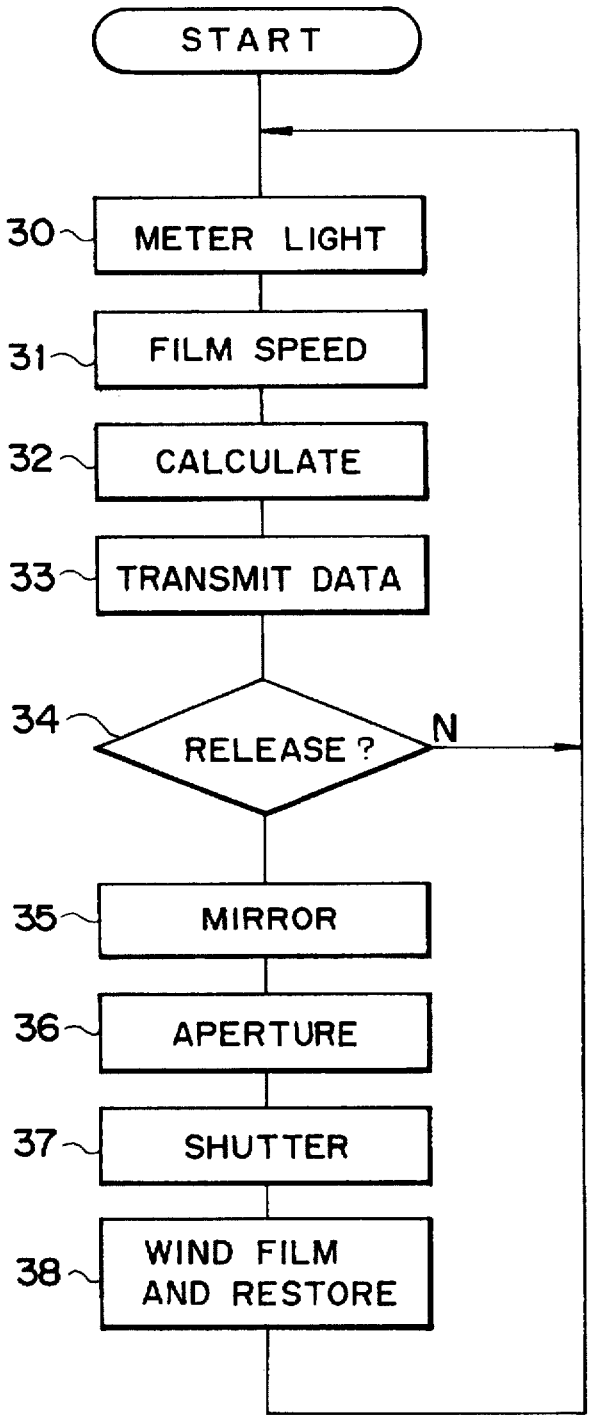
FIG. 3 is a flow chart showing a processing routine of a CPU in a camera which adopts the display driving apparatus according to the embodiment shown in FIG. 1.

FIG. 3 is a flow chart showing a processing routine of the CPU in the camera, which adopts the display driving apparatus according to this embodiment.

Execution of this routine is started when the CPU 14 is powered. The CPU 14 receives an object brightness signal from the photometry circuit 11 (step 30), and also receives a film speed signal from the film speed detection circuit 12 (step 31). Thereafter, the CPU 14 calculates a proper exposure condition on the basis of the object brightness signal and the film speed signal (step 32).

The CPU 14 transmits display data corresponding to the calculated proper exposure condition to the CPU 26 in the back lid 5 (step 33).

The CPU 14 detects whether or not a release switch (not shown) is turned on upon operation of the shutter button 3 (step 34). If it is determined that the release switch is not turned on, the flow returns to step S30 to repeat the above-mentioned routine.

If it is determined that the release switch is turned on, the CPU 14 drives a mirror (not shown) to cause it to escape from an optical path (step 35), sets a predetermined value in the aperture 17 (step 36), and opens the shutter 16 for a predetermined period of time (step 37), thereby projecting object light onto a film.

After the exposure operation, the CPU 14 rotates the motor 18 to wind up the film by one frame, and restores the mirror, the aperture 17, and the like (step 38). Thereafter, the flow returns to step 30 to repeat the above-mentioned routine.

Figure 4:
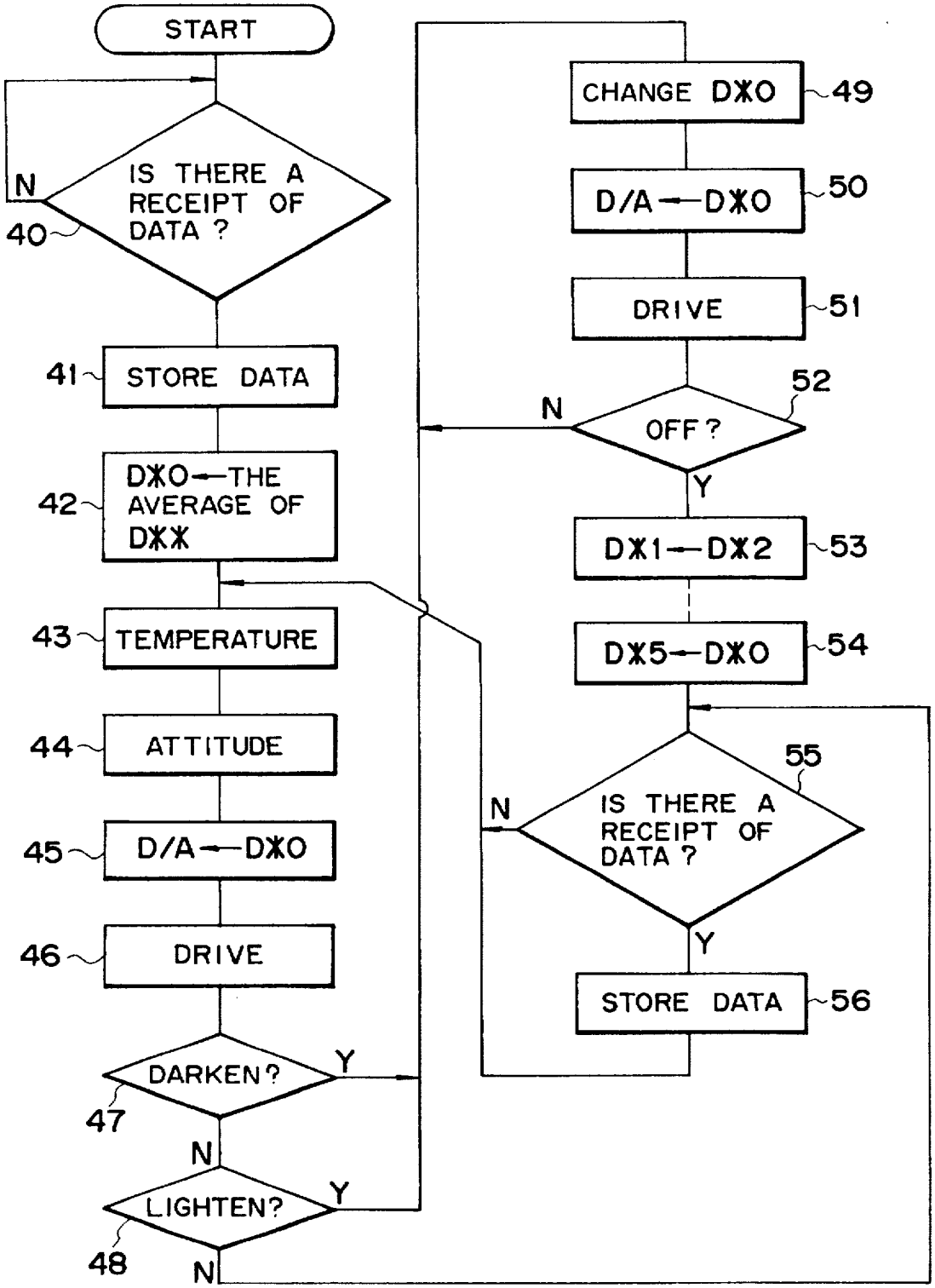
FIG. 4 is a flow chart showing a processing routine of a CPU in a back lid of the camera, which adopts the display driving apparatus according to the embodiment shown in FIG. 1.

FIG. 4 is a flow chart showing a processing routine executed by the CPU in the back lid of the camera which adopts the display driving apparatus according to this embodiment.

This processing is started when the CPU 26 is powered. The CPU 26 waits for display data transmitted from the camera 1 (step 40), and stores the transmitted display data in the memory circuit 22 (step 41). Note that the display data may be stored in an internal RAM (not shown) of the CPU 26.

The CPU 26 averages density data D in a table in the memory circuit 22**, which data are stored in a previous operation, and are classified in units of the attitudes and temperatures, thereby calculating average density data D*0 (step 42). Detailed explanation of this processing will be given in connection with Table 1 to be described later.

The CPU 26 receives the current temperature detected by the temperature detection circuit 21 (step 43). The CPU 26 also receives the attitude of the camera 1 detected by the mercury switches 9 (step 44).

The CPU 26 drives the D/A converter 24 with density data optimal for the temperature and attitude input in steps 43 and 44, i.e., the average density data D*0 calculated in step 42 (step 45).

The CPU 26 outputs the display data temporarily stored in step 41 to the driving circuit 25 so as to selectively turn on the segments in the LCD 6 (step 46).

The CPU 26 then checks if the density adjustment button 7 is turned on to increase the density (step 47). Also, the CPU 26 checks if the density adjustment button 8 is turned on to decrease the density (step 48).

If it is determined that the density adjustment button 7 or 8 is turned on, the CPU 26 changes the data D*0 with reference to the adjusted density data (step 49). This means that the D/A converter 24, which is driven by the average density data D*0 in step 45, is alternatively driven by manually adjusted driving data in only this case. The D/A converter 24 is driven by the changed density data D*0 (step 50).

The CPU 26 drives the driving circuit 25 with display data temporarily stored in step 41 or 56 (to be described later) (step 51). Thus, the density of the LCD 6 is adjusted.

The CPU 26 checks if the density adjustment button 7 or 8 is turned off (step 52). If it is determined that the density adjustment button 7 or 8 is kept ON, the processing is repeated from step 49 to continuously change the density of the LCD 6.

If it is determined that the density adjustment button 7 or 8 is turned off, stored density data are advanced in units of columns (step 53). Data D*2 is stored at the position of data D*1, and finally, the manually adjusted density data D*0 is stored at the position of data D*5 (step 54). Thus, the data D*0 is copied to the data D*5 without being erased.

In steps 55 and 56, data reception and storage operations are executed as in steps 40 and 41.

TABLE 1

| Attitude | Ordinary Position | | | |
|---|---|---|---|---|
| Temperature °C. | Not More Than −20 | From 0 to −20 | From +20 to 0 | Not less Than +20 |
| Data 1 | D11 | D21 | D31 | D41 |
| Data 2 | D12 | D22 | D32 | D42 |
| Data 3 | D13 | D23 | D33 | D43 |
| Data 4 | D14 | D24 | D34 | D44 |
| Data 5 | D15 | D25 | D35 | D45 |
| Data 0 | D10 | D20 | D30 | D40 |

A further detailed explanation of the operation of this embodiment will be given below with reference to Table 1 above. Table 1 partially shows a density data map in the memory circuit 22.

The types of attitudes such as "ordinary position", "vertical position", "upside-down position", and the like are prepared as main classifications. In each main classification, temperature ranges "not more than −20° C.", "from −20° C. to 0° C.", "from 0° C. to +20° C.", and "not less than +20° C." are prepared as sub classifications. Each sub classification stores five raw data "data 1" to "data 5", and "data 0" as average value data of the five raw data or manually adjusted data.

For example, Table 1 shows only a map of "ordinary position". The processing of Table 1 will be described below in correspondence with steps in FIG. 4. For the sake of simplicity, assume that the attitude is "ordinary position", and the temperature is "not less than +20° C.".

In step 49, the manually adjusted latest density data is stored as data D40. The data D40 is used for driving the LCD in next step 50.

In steps 53 and 54, data D41 as the oldest data is deleted, and data D42 is stored instead. Similarly, processing for storing data D43 at the position of data D42, data D44 at the position of data D43, and data D40 at the position of D45 is executed. More specifically, the data are shifted and updated to the latest data set. At this time, the latest data D40 is left unchanged, and is also stored as data D45.

The above-mentioned processing is executed for portions associated with the attitude and temperature obtained when the density adjustment button 7 or 8 is turned on.

In step 42, numerical values of data 1 to data 5 are averaged to obtain a value of data 0 in each sub classification. Since this step is executed immediately after the operation of the camera is started, the display operation of the LCD 6 must be performed. In this case, an optimal density condition is set as the average value of the previously stored data 1 to 5.

In the embodiment described above, the number of data is five for the sake of simplicity. However, processing may be executed using six or more data.

Upon calculation of an optimal bias value, a square mean may be used as the average value in place of the arithmetic mean. When the square mean is used, a user's preference can be better exhibited.

Furthermore, the average value may be calculated after the maximum or minimum value is excluded. In this manner, data in an extreme use condition can be excluded.

Moreover, an optimal value may be calculated based on another statistical processing such as weighting.

In this embodiment, the method of changing the bias value of the LCD by varying the output value from the D/A converter has been exemplified. However, any other method may be employed as long as the bias value of the LCD can be optimized.

As described in detail above, according to the present invention, since the visual state of an electro-optical display unit is automatically optimized on the basis of a plurality of data corresponding to temperatures in a photographing operation, a plurality of data corresponding to photographing attitudes of a user, and a plurality of data corresponding to a user's preference, an extra operation for adjusting the visual state by changing the bias value upon rotation of an adjustment dial every time the camera is used can be omitted.

Therefore, in the case of a camera, since photographing information can be confirmed immediately after a photographing preparation operation, a change in temperature in a photographing operation, or a change in photographing attitude, an important shutter chance can be prevented from being lost.

What is claimed is:

1. A display driving apparatus comprising:

an electro-optical display;

a temperature detection unit for detecting an ambient temperature of said electro-optical display;

a voltage generation portion for generating a voltage to be applied to said electro-optical display;

a changing portion for changing a value of the voltage generated by said voltage generation portion;

a memory for storing a plurality of groups of voltage values for a corresponding plurality of predefined temperature classifications, each group of voltage values including plurality of voltage values;

an updating portion for updating the groups of voltage values stored in said memory to include most recent changed voltage values;

a processing portion for executing statistical processing of the updated groups of voltage values stored in said memory; and a controller for causing said voltage generation portion to generate a voltage based on a detected ambient temperature and a processing result of the statistical processing of an updated group of stored voltage values for a temperature classification corresponding to the detected ambient temperature.

2. An apparatus according to claim 1, wherein said changing portion is manually operable from outside the apparatus.

3. A display driving apparatus comprising:

an electro-optical display;

an attitude detection unit for detecting an attitude of said electro-optical display;

a voltage generation portion for generating a voltage to be applied to said electro-optical display;

a changing portion for changing a value of the voltage generated by said voltage generation portion;

a memory for storing a plurality of groups of voltage values for a corresponding plurality of predefined attitude classifications, each group of voltage values including a plurality of voltage values;

an updating portion for updating the groups of voltage values stored in said memory to include most recent changed voltage values;

a processing portion for executing statistical processing of the updated groups of voltage values stored in said memory; and a controller for causing said voltage generation portion to generate a voltage based on a detected attitude of said electro-optical display and a processing result of the statistical processing of an updated group of stored voltage values for an attitude classification corresponding to the detected attitude.

4. An apparatus according to claim 3, wherein said changing portion is externally operated to change the value of the voltage generated by said voltage generation portion.

5. A display driving apparatus comprising:

an electro-optical display;

a voltage generation portion for generating a voltage to be applied to said electro-optical display;

a changing portion for changing a value of the voltage generated by said voltage generation portion;

a memory for storing a history of voltage values as changed by said changing portion;

an updating portion for updating the history of voltage values stored in said memory to include most recent changed voltage values;

a processing portion for executing calculational processing of the updated history of voltage values stored in said memory to produce a calculation result that is dependent upon at least two of said most recently changed voltage values at the same time; and a controller for causing said voltage generation portion to generate a voltage based on said calculation result.

6. An apparatus according to claim 5, wherein said processing portion weights a more recent one of the updated history of stored voltage values with a larger weight in the calculational processing.

7. An apparatus according to claim 5, wherein said processing portion calculates a mean square of the updated history of stored voltage values in the calculational processing.

8. An apparatus according to claim 5, wherein said processing portion executes the calculational processing by excluding a maximum value and/or a minimum value from the updated history of stored voltage values.

9. An apparatus according to claim 5, wherein said processing portion calculates an arithmetic mean of the updated history of stored voltage values in the statistical processing.

10. An apparatus according to claim 5, wherein said changing portion changes a value of the voltage generated by said voltage generation portion in response to an external operation by an operator.

11. A method of driving a display apparatus, comprising the steps of:

storing in a memory a plurality of groups of voltage values for a corresponding plurality of predefined ambient temperature classifications of an electro-optical display, each group of voltage values including a plurality of voltage values;

detecting ambient temperature of the electro-optical display;

generating a voltage to be applied to the electro-optical display;

changing a value of the generated voltage;

updating one of the groups of voltage values stored in the memory to include the changed voltage value; and in association with detection of an ambient temperature corresponding to the updated group of stored voltage values, generating a further voltage to be applied to the electro-optical display based on a processing result of statistical processing of the updated group of voltage values.

12. A method of driving a display apparatus, comprising the steps of:

storing in a memory a plurality of groups voltage values for a corresponding plurality of predefined attitude classifications of an electro-optical display, each group of voltage values including a plurality of voltage values;

detecting attitude of the electro-optical display;

generating a voltage to be applied to the electro-optical display;

changing a value of the generated voltage;

updating one of the groups of voltage values stored in the memory to include the changed voltage value; and in association with detection of an attitude corresponding to the updated group of stored voltage values, generating a further voltage to be applied to the electro-optical display based on a processing result of statistical processing of the updated group of stored voltage values.

13. A method of driving a display apparatus, comprising the steps of:

providing a memory for storing a history of voltage values;

generating voltages at different times for application to at electro-optical display;

changing respective values of the generated voltages;

updating the memory to store a plurality of most recently changed voltage values in the history; and generating a further voltage to be applied to the electro-optical display based on a calculation result of calculational processing of the undated history, said calculation result being dependent upon at least two of said most recently changed voltage values at the same time.

* * * * *